US005923240A

United States Patent [19]

Endo et al.

[11] Patent Number: 5,923,240

[45] Date of Patent: Jul. 13, 1999

[54] TEMPERATURE FUSE

[75] Inventors: Takayoshi Endo; Goro Nakamura, both of Shizuoka, Japan

[73] Assignee: Yazaki Corporation, Tokyo, Japan

[21] Appl. No.: 09/093,615

[22] Filed: Jun. 9, 1998

[30] Foreign Application Priority Data

Jun. 10, 1997 [JP] Japan ..... 9-152325

[51] Int. Cl.[6] ..... H01H 37/76; H01H 85/30; H01H 85/02

[52] U.S. Cl. ..... 337/405; 337/268; 337/401; 337/404; 337/414

[58] Field of Search ..... 337/158, 268, 337/159, 290, 401, 413, 414, 416, 403, 404, 405, 407, 408, 409

[56] References Cited

U.S. PATENT DOCUMENTS

| | | | |
|---|---|---|---|
| 4,132,913 | 1/1979 | Lautner et al. | 310/68 |
| 4,184,139 | 1/1980 | Hara | 337/407 |
| 4,198,617 | 4/1980 | Hara | 337/403 |
| 4,494,104 | 1/1985 | Holmes | 337/403 |
| 4,800,358 | 1/1989 | Takenouchi et al. | 337/268 |
| 5,097,247 | 3/1992 | Doerrwaechter | 337/405 |
| 5,606,483 | 2/1997 | Sawai et al. | 361/106 |
| 5,682,057 | 10/1997 | Kuriyama | 257/529 |

FOREIGN PATENT DOCUMENTS

| | | | |
|---|---|---|---|
| 406260067 | 9/1994 | Japan | H01H 37/76 |
| 409035603 | 2/1997 | Japan | H01H 37/76 |

*Primary Examiner*—Leo P. Picard
*Assistant Examiner*—Anatoly Vortman
*Attorney, Agent, or Firm*—Morgan, Lewis & Bockius LLP

[57] ABSTRACT

A temperature fuse for use in an electric circuit provided in an automobile or the like. The temperature fuse includes a pressure-contact terminal having a pressure-contact blade, a temperature opening and closing member having one end connected electrically to the pressure-contact terminal, a signal wire connecting terminal connected electrically to the other end of the temperature opening and closing member, and an insulating case for receiving therein the pressure-contact terminal and the temperature opening and closing member in such a manner that at least the pressure-contact blade and the signal wire connecting terminal are exposed outwardly from the insulating case.

8 Claims, 5 Drawing Sheets

TEMPERATURE FUSE

BACKGROUND OF THE INVENTION

1. Field of the Invention

The present invention relates to a temperature fuse for use in an electric circuit provided in an automobile or the like and, in more particular, to such a temperature fuse which allows a signal current to be taken out from a circuit wiring the temperature of which is to be detected.

2. Description of the Related Art

Conventionally, in an electric circuit for use in an automobile or the like, a cartridge type of fuse 1 as shown in FIG. 3 is used. This fuse 1 is structured such that a pair of terminals 3 and 3 is connected to each other by a fuse element 5, the connected terminals are mounted within a housing 7 formed of insulating heat-resistant resin, and an opening 9 formed in the top portion of the housing 7 is closed by a transparent cover 11. In the interior portion of the housing 7, a terminal receiving chamber for receiving the terminals 3, 3 therein, and an element receiving space which communicates with the terminal receiving chamber there are formed. When the terminals 3, 3 are received into the terminal receiving chamber, the fuse element 5 is thereby situated in the element receiving space, so that whether the fuse element 5 is fused or not can be visually confirmed through the transparent cover 11. In particular, the fuse element 5 includes a fusible portion formed of low fusing-point metal such as lead, tin or the like which, when a current of a rated level or more flows therein, is heated by such a current and is thereby fused due to the thus generated heat. In other words, if the fusible portion is fused, then the electric circuit is opened to thereby protect electric wires and devices.

The above-mentioned conventional fuse 1, generally, has such a correlation between an energizing current and a prearcing time as shown in FIG. 4. Meaning, when a current 200% or more than a fuse rating flows, the fusible portion of the fuse 1 is fused immediately; and, when a current 200% or less than the fuse rating flows, the fusing time of the fusible portion is relatively long because the fuse 1 has durability against a rush current. Also, when there flows a short current which is not continuous but intermittent as in a rare short circuit, the fusible portion of the fuse element 5 generates and radiates heat alternately and repetitively in the element receiving space, so that the fusing time of the fusible portion can be made longer. On the other hand, in an electric wire forming the electric circuit, even if the intermittent short current flows, heat is not radiated in the fusible portion even in the current cut-off time because the electric wire is covered with a wire cover, but the temperature of the electric wire continues to rise due to storage of heat and, in the worst case, there is a fear that the electric wire may give off smoke or the like.

In order to eliminate the drawbacks found in the above-mentioned conventional cartridge type fuse, conventionally, there has been sometimes used a temperature fuse which is able to detect the temperature of an electric wire used in an electric circuit. In particular, a temperature fuse 13 is structured such that, as shown in FIG. 5, two lead wires 17 and 17 are respectively connected to the two ends of a low fusing-point metal member 15, the low fusing-point metal member 15 is covered with a film 19 having a lower fusing point than the low fusing-point metal member 15, and the film 19 is in turn covered with an insulating case 21. According to the temperature fuse 13, the low fusing-point metal member 15 portion is mounted on a circuit wiring the temperature of which is to be detected, and the lead wires 17, 17 are connected by soldering to an alarm circuit or a forced cutoff circuit, whereby, when the circuit wiring reaches a temperature which is equal to or higher than a given temperature, the low fusing-point metal member 15 is fused at the current temperature, and the alarm circuit or forced cutoff circuit is operated to turn on an alarm light or cut off the circuit, thereby protecting the circuit.

However, when such a temperature fuse 13 is used, there two electric wires are required, an exclusive power supply wire and a signal wire. Also, when the space for provision of an electric wire is limited, there is a fear that the temperature fuse 13 cannot be mounted onto the circuit wiring using to a method of winding tape around the same. Further, since the power supply wire is necessary, when a proper power supply terminal is not provided near the circuit wiring, the temperature fuse 13 cannot be mounted onto the circuit wiring.

SUMMARY OF THE INVENTION

The present invention aims at eliminating the drawbacks found in the above-mentioned conventional fuses. Accordingly, it is an object of the invention to provide a temperature fuse which not only, especially when a short circuit occurs in a circuit using a large current, is able to detect the abnormal heat generation of an electric wire used in the circuit and cut off the circuit or inform a driver of occurrence of such abnormal heat generation condition, but also can be assembled to the circuit easily.

In attaining the above object, according to the invention, there is provided a temperature fuse comprising: a pressure-contact terminal including a pressure-contact blade; temperature opening and closing means having one end connected electrically to the pressure-contact terminal; a signal wire connecting terminal connected electrically to the other end of the temperature opening and closing means; and an insulating case for receiving therein the pressure-contact terminal and the temperature opening and closing means in such a manner that at least the pressure-contact blade and the signal wire connecting terminal are exposed from the insulating case.

DETAILED DESCRIPTION OF THE PREFERRED EMBODIMENT

Now, description will be given below in detail of a preferred embodiment of a temperature fuse according to the invention with reference to the accompanying drawings.

Figure 1:
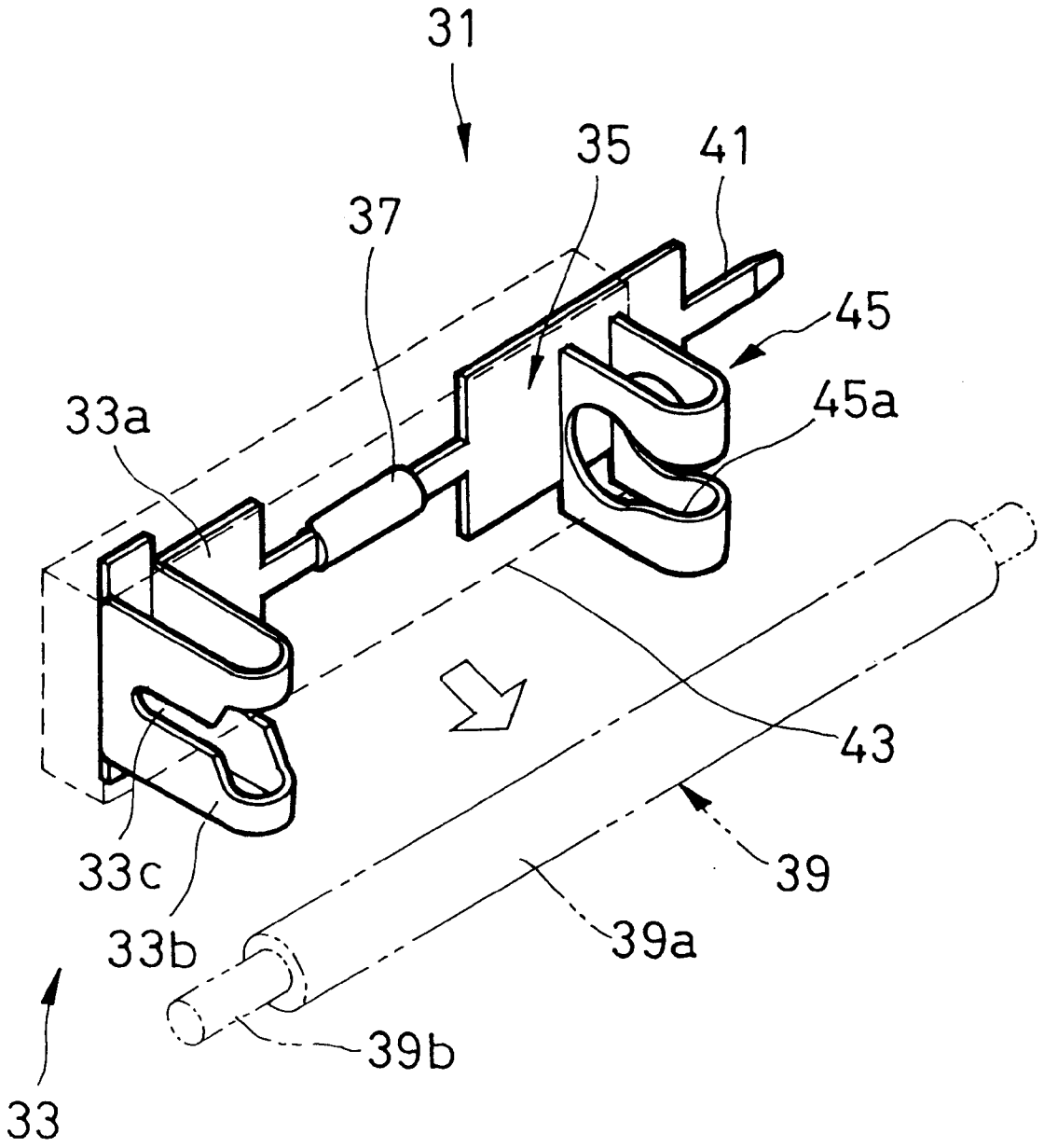
FIG. 1 is a perspective view of a preferred embodiment of a temperature fuse according to the invention.
Figure 2:
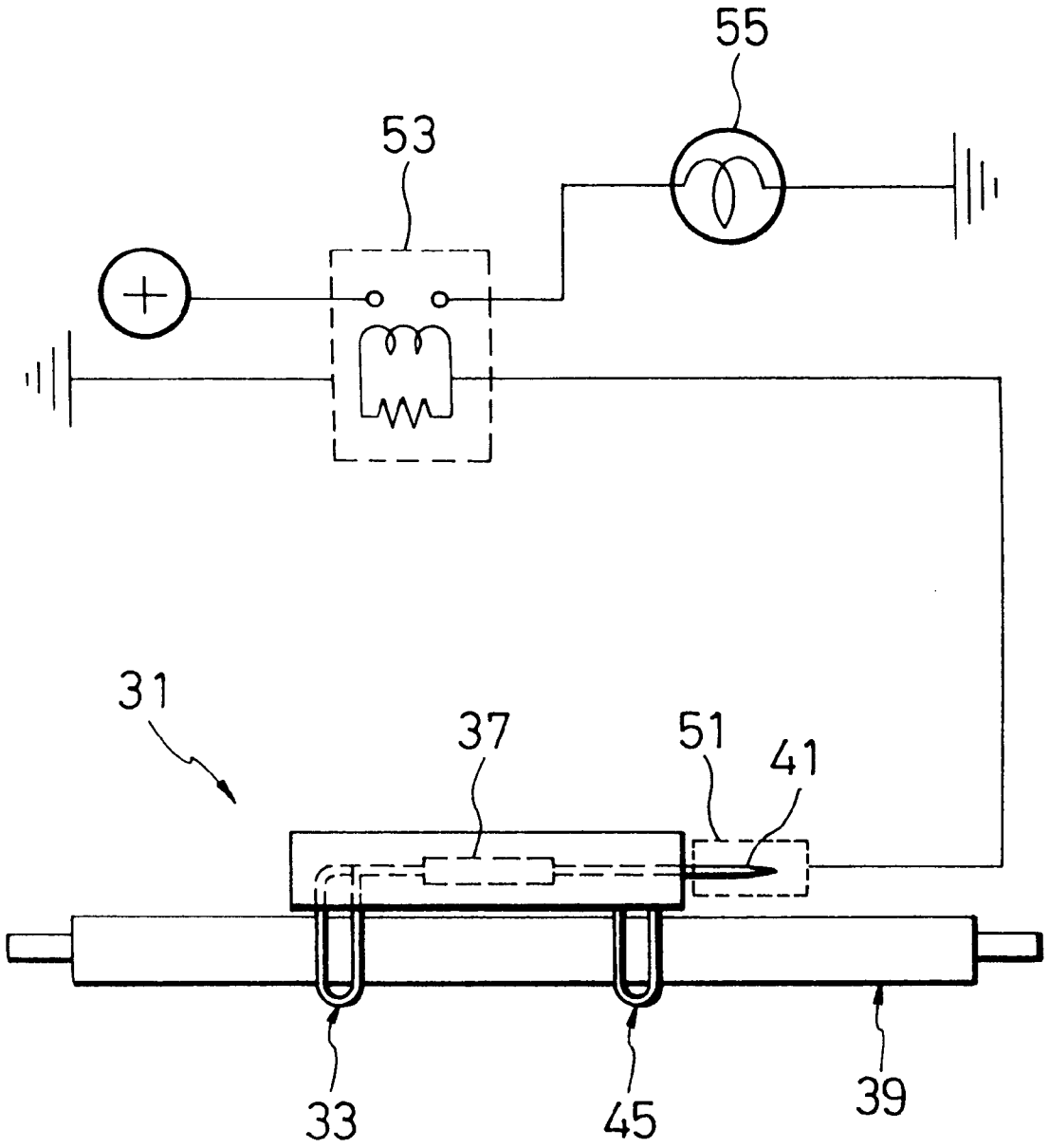
FIG. 2 is an explanatory view of the temperature fuse shown in FIG. 1, showing how it is used.
Figure 3:
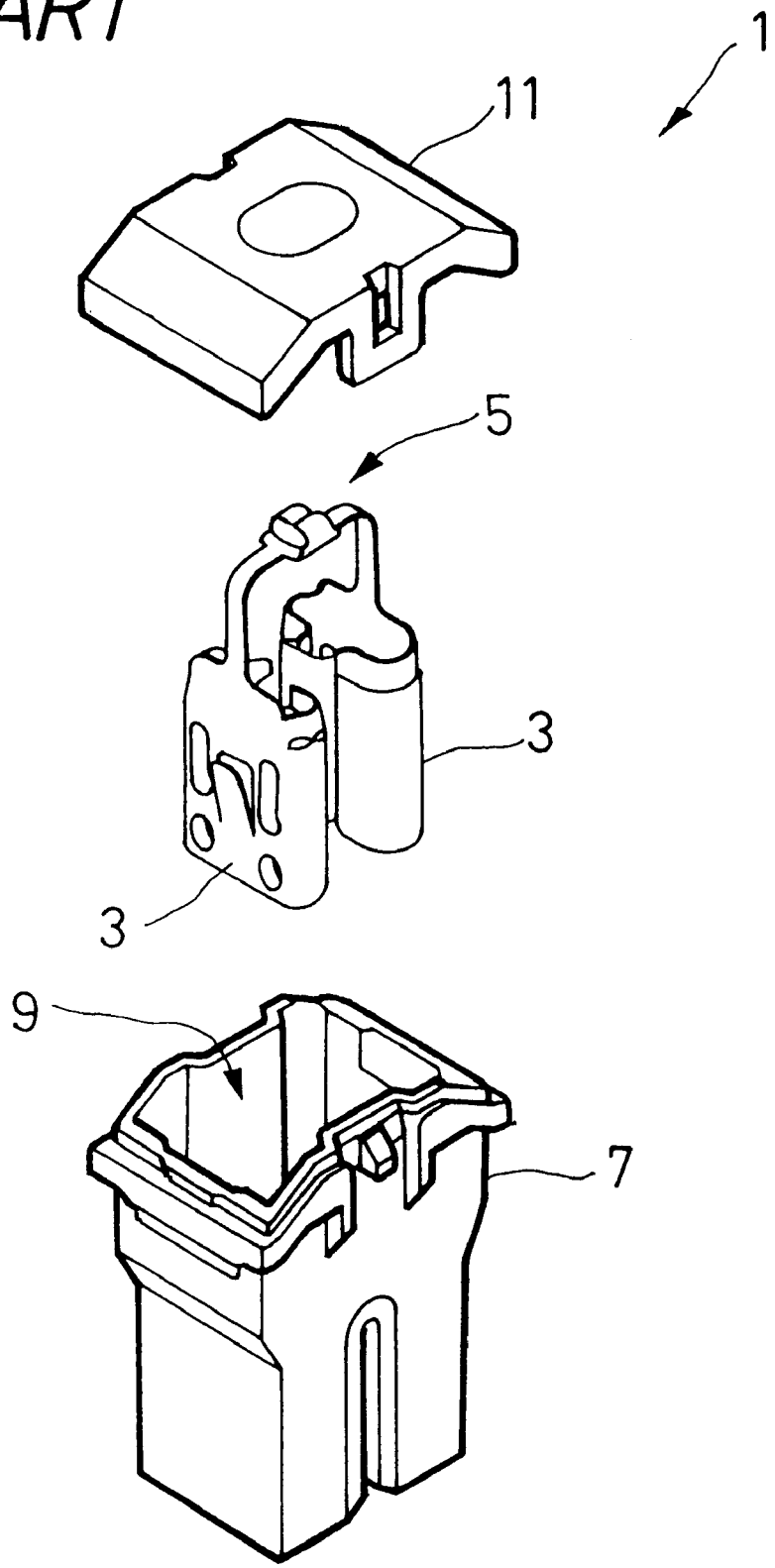
FIG. 3 PRIOR ART
FIG. 3 is an exploded perspective view of a conventional large current fuse.
Figure 4:
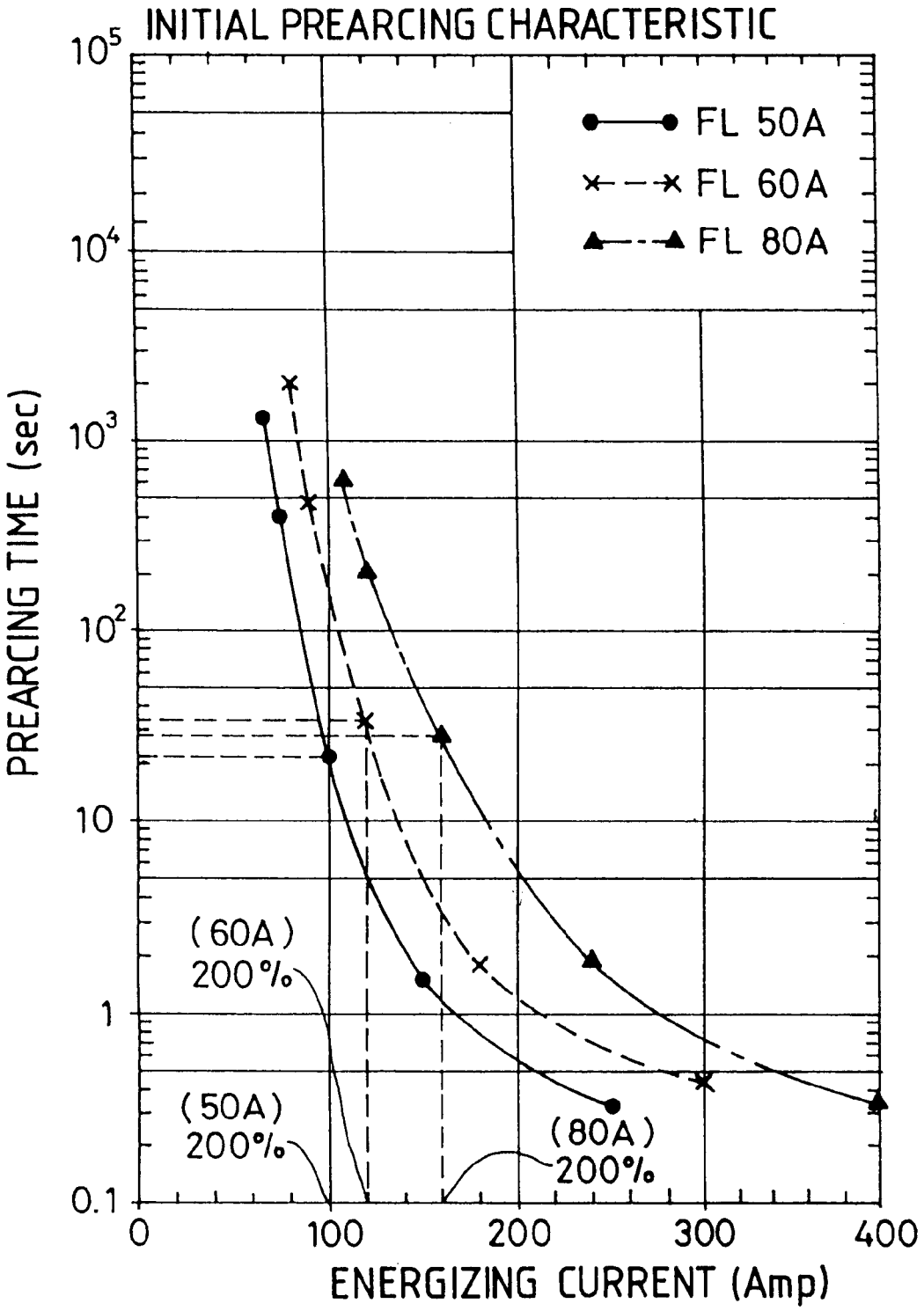
FIG. 4 PRIOR ART
FIG. 4 is a graphical representation of the prearcing characteristic of the conventional large current fuse.
Figure 5:
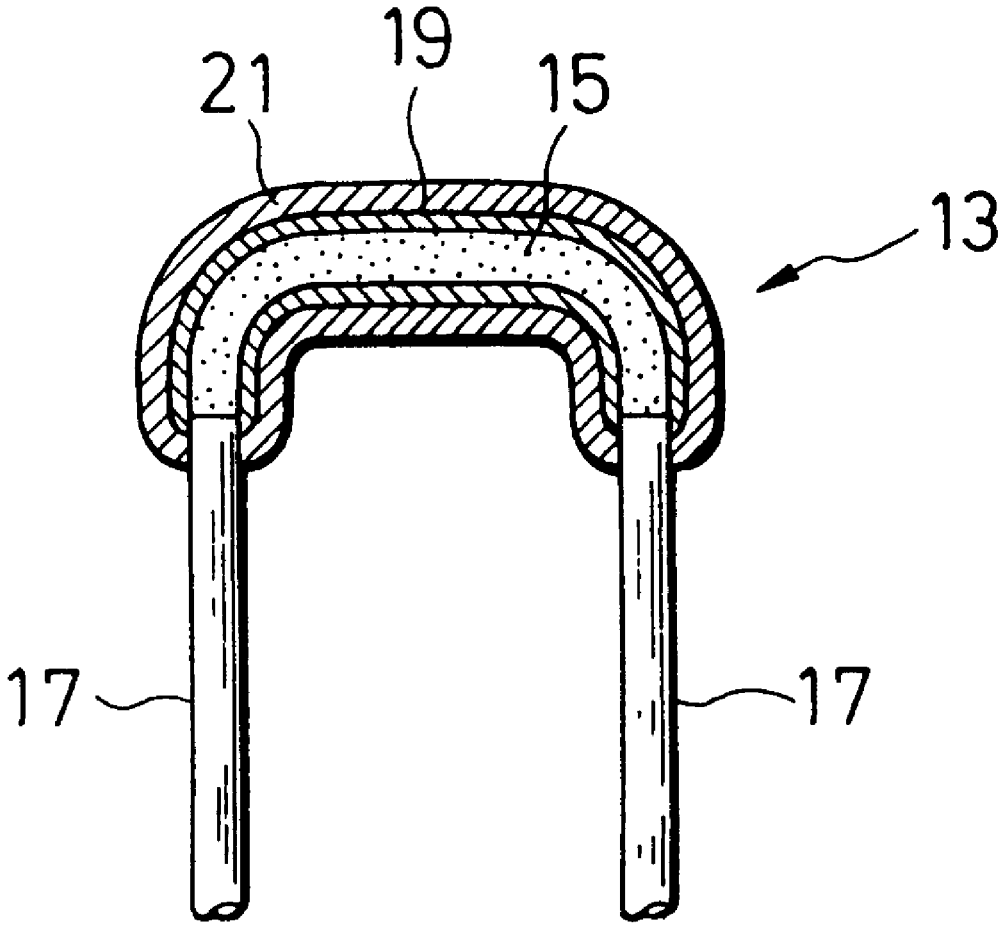
FIG. 5 PRIOR ART
FIG. 5 is a sectional view of another conventional temperature fuse.

In particular, FIG. 1 is a perspective view of a preferred embodiment of a temperature fuse according to the invention, and FIG. 2 is an explanatory view of the temperature fuse shown in FIG. 1, showing how it is used.

A temperature fuse 31 includes a pressure-contact terminal 33 in one end portion thereof and a connecting plate 35 in the other end portion thereof, while the pressure-contact terminal 33 and connecting plate 35 are electrically connected to each other by a low fusing-point metal member 37 which serves as temperature opening and closing means.

The pressure-contact terminal 33 includes a base plate portion 33*a* and a pressure-contact portion 33*b* which is so formed as to stand up at right angles from the base plate portion 33*a*, while the pressure-contact portion 33*b* includes a pressure-contact blade (slot) 33*c* which is formed by cutting a portion of the pressure-contact portion 33*b* including an upper side thereof into a U shape. The pressure-contact terminal 33 is structured such that, when a circuit wiring (which is a covered electric wire) 39 the temperature of which is to be detected is pressure-inserted into the pressure-contact portion 33*b*, the pressure-contact blade 33*c* cuts open a cover 39*a* of the covered electric wire 39 so that the pressure-contact terminal 33 can be electrically contacted with a core 39*b* of the covered electric wire 39.

The low fusing-point metal member 37 has an electric conductivity and can be fused due to its ambient temperature which is equal to or higher than a given temperature. Basically, the low fusing-point metal member 37 is not fused by a current but is fused by the ambient temperature. However, when a large current flows in the case of a short circuit, there is generated Joule heat due to the conductor resistance of the low fusing-point metal member 37, so that the low fusing-point metal member 37 can be fused due to the generated Joule heat as well.

The connecting plate 35, which is connected to the pressure-contact terminal 33 through the low fusing-point metal member 37, is formed of a square metal plate having an electric conductivity. The connecting plate 35 includes a signal wire connecting terminal (a male terminal) 41 which is formed of a narrow plate and extends from one side of the connecting plate 35, while the male terminal 41 can be connected to a female connector (to be discussed later) which is guided from an alarm circuit or the like.

Now, the base plate portion 33*a* of the pressure-contact terminal 33, low fusing-point metal member 37, and connecting plate 35 are respectively received in an insulating case 43. The insulating case 43 is structured such that at least the pressure-contact portion 33*b* of the pressure-contact terminal 33 and the male terminal 41 of the connecting plate 35 are allowed to project outwardly thereof. On the outside of the insulating case 43, there is disposed an electric wire hold portion 45 which is opposed to and in parallel to the projecting pressure-contact portion 33*b*. The electric wire hold portion 45 includes a pressure-insertion portion 45*a* which is formed by cutting a portion of the electric wire hold portion 45 including an upper side thereof into a U shape so; that if the covered electric wire 39 is pressure-inserted into the pressure-insertion portion 45*a* of the electric wire hold portion 45, then the electric wire hold portion 45 cooperates with the pressure-contact terminal 33 in holding the temperature fuse 31 on the covered electric wire 39.

Now, description will be given below of the operation of the temperature fuse 31 structured in this manner.

As shown in FIG. 2, if the pressure-contact terminal 33 and the electric wire hold portion 45 are pressure-inserted into the covered electric wire 39, then the temperature fuse 31 can be mounted onto the covered electric wire 39.

The male terminal 41 of the temperature fuse 31 is connected through a female connector 51 to, for example, the signal input terminal of a relay 53. Also, the relay 53 is structured such that it is able to open and close the power supply circuit of an alarm 55 in accordance with an input signal from the temperature fuse 31.

By bringing the pressure-contact terminal 33 into contact with the covered electric wire 39 by pressure, the covered electric wire 39 is branched by the temperature fuse 31, so that a branch current flows through the temperature fuse 31 to the relay 53. The relay 53 receives this branch current as a detection signal and, normally, holds the power supply circuit of the alarm 55 in its open state.

If an intermittent short circuit or the like occurs in the circuit and thus the temperature of the covered electric wire 39 is raised due to such heat storage, then the low fusing-point metal member 37 of the temperature fuse 31 is fused. This cuts off the branch current from the covered electric wire 39 to the relay 53, so that the relay 53 closes the power supply circuit of the alarm 55 to operate the alarm, thereby being able to issue an alarm to the driver of the automobile.

In the above-mentioned embodiment, the power supply circuit of the alarm 55 is opened and closed by the relay 53. However, this is not limited since the relay 53 may also be structured such that it directly opens and closes the power source of the circuit to be protected.

Also, in the above-mentioned description, there is shown a case in which the low fusing-point metal member 37 can be fused only due to the heat generation of the covered electric wire 39. However, the invention is not limited to this since the low fusing-point metal member 37 may also be structured such that it is able to generate Joule heat due to a current flowing when a short circuit is occurred and it can be fused due to the thus generated Joule heat.

As described above, according to the temperature fuse 31, since the pressure-contact terminal 33 is provided, the connecting plate 35 is connected to the pressure-contact terminal 33 through the low fusing-point metal member 37, and the male terminal 41 is provided in the connecting plate 35, by inserting the pressure-contact terminal 33 and the electric wire hold portion 45 into the covered electric wire 39 by pressure, not only the temperature fuse 31 can be mounted onto the covered electric wire 39 very easily, but also the branch current as a detection signal can be taken out from the covered electric wire 39. As a result of this, the temperature fuse 31 can be mounted simply even in a limited space and also wiring can be achieved using a single electric wire with no use of an exclusive power supply wire.

Also, since no power supply wire is needed, the temperature fuse 31 can be mounted easily after the electric circuit is provided and, at the same time, since the pressure-contact terminal 33 and the electric wire hold portion 45 of the temperature fuse 31 are respectively pressure-inserted into and held by the covered electric wire 39, the temperature fuse 31 can be mounted at an arbitrary position of the electric circuit, that is, at an arbitrary position of the covered electric wire 39 the temperature of which is to be detected.

In addition, with use of the thus structured temperature fuse 31, even in a rare short circuit in which a fuse provided in an ordinary circuit is not fused, the temperature fuse 31 can be fused. Meaning, the circuit can be cut off in accordance with a fusion signal indicating the fused condition of the temperature fuse 31, or an alarm can be issued to the driver.

In the above-mentioned temperature fuse 31, as the temperature opening and closing means, the low fusing-point metal member 37 is used. However, this is not limited since the temperature opening and closing means may be formed of a bimetal or the like which, normally, closes a contact to thereby keep conduction and, at high temperatures, opens the contact. With use of the bimetal type of temperature opening and closing means, repeated use of the temperature fuse 31 can be realized.

As has been described heretofore in detail, according to the temperature fuse of the invention, since the pressure-contact terminal and the signal wire connecting terminal are connected to each other through the temperature opening and closing means, by pressure-inserting the pressure-contact terminal into a circuit electric wire, the temperature fuse can be mounted quite easily and, at the same time, the branch current as a detection signal can be taken out from the circuit electric wire. As a result of this, the assembling efficiency of the temperature fuse can be improved. Also, even in a rare short circuit in which a fuse provided in an ordinary circuit is not fused, the abnormal heat generation of the circuit electric wire can be detected, thereby being able to cut off the circuit or issue an alarm to the driver. This makes it possible to protect the electric wire and circuit against an abnormal current due to a rare short circuit, while such protection has been difficult in the conventional temperature fuse.

In addition, with use of the low fusing-point metal member as the temperature opening and closing means, it is easy to realize a structure which can cut off conduction between the pressure-contact terminal and the signal wire connecting terminal due to the heat generation of the circuit electric wire.

What is claimed is:

1. A temperature fuse comprising:

a pressure-contact terminal including a pressure-contact blade for cutting through a cover of a wire and contacting a core of the wire;

temperature opening and closing means having one end connected electrically to said pressure-contact terminal;

a signal wire connecting terminal connected electrically to another end of said temperature opening and closing means and extending parallel to said temperature opening and closing means; and an insulating case for receiving therein said pressure-contact terminal and said temperature opening and closing means in such a manner that at least said pressure-contact blade and said signal wire connecting terminal are exposed from said insulating case.

2. The temperature fuse as set forth in claim 1, wherein said temperature opening and closing means is formed of a low fusing-point metal member which is fused due to its ambient temperature.

3. The temperature fuse as set forth in claim 1, wherein an electric wire hold portion which is opposed to and in parallel to a pressure-contact portion of said pressure-contact terminal including the pressure-contact blade is disposed on the outside of said insulating case.

4. A temperature fuse comprising:

a pressure-contact terminal including a plate, a pressure-contact portion, and a blade, the blade extending substantially perpendicularly from the plate;

a holding terminal including a plate and a wire holding portion spaced from and parallel to the pressure-contact portion, the wire holding portion extending substantially perpendicular from the holding terminal plate, the holding terminal plate including a first side and a second side;

temperature opening and closing means having one end electrically connected to the pressure-contact terminal plate and another end electrically connected to the first side of the holding terminal plate;

a signal wire connecting terminal extending from the second side of the holding terminal plate; and a insulating case for receiving therein the pressure-contact terminal and the temperature opening and closing means in such a manner that at least said pressure-contact blade and the signal wire connecting terminal are exposed from the insulating case.

5. The temperature fuse as set forth in claim 4, wherein the temperature opening and closing means is formed of a low fusing-point metal member which is fused due to its ambient temperature.

6. The temperature fuse as set forth in claim 4, wherein the electric wire holding portion is disposed on the outside of the insulating case.

7. A temperature fuse comprising:

a pressure-contact terminal including a plate and a blade for cutting through a cover of a wire and contacting a core of the wire;

a holding terminal including a plate and a wire holding portion, the holding terminal plate including a first side and a second side;

temperature opening and closing means having one end electrically connected to the pressure-contact terminal plate and another end electrically connected to the first side of the holding terminal plate;

a signal wire connecting terminal extending from the second side of the holding terminal plate so that the signal wire connecting terminal extends parallel to the temperature opening and closing means.

8. The temperature fuse as set forth in claim 7, wherein said temperature opening and closing means is formed of a low fusing-point metal member which is fused due to its ambient temperature.

* * * * *